United States Patent [19]

Christensen

[11] Patent Number: 4,769,130

[45] Date of Patent: Sep. 6, 1988

[54] HIGH-GRADIENT MAGNETIC SEPARATOR

[75] Inventor: Orla Christensen, Copenhagen, Denmark

[73] Assignee: A/S Niro Atomizer, Denmark

[21] Appl. No.: 498,095

[22] Filed: May 25, 1983

Related U.S. Application Data

[63] Continuation-in-part of Ser. No. 413,249, Aug. 30, 1982.

[30] Foreign Application Priority Data

Mar. 12, 1982 [DK] Denmark ..... 1115/82
Mar. 11, 1983 [EP] European Pat. Off. ..... 83301361.8

[51] Int. Cl.[4] ..... B03C 1/00
[52] U.S. Cl. ..... 209/223.1; 210/222
[58] Field of Search ..... 209/223 R, 224; 210/222, 223; 148/101

[56] References Cited

U.S. PATENT DOCUMENTS

| | | | |
|---|---|---|---|
| 3,567,026 | 3/1971 | Kolm | 210/222 |
| 3,627,678 | 12/1971 | Marston et al. | 210/222 X |
| 3,682,715 | 8/1972 | Martin | 148/101 X |
| 3,811,962 | 5/1974 | Benz | 148/101 X |
| 3,850,811 | 11/1974 | Wheelock | 209/223 R X |
| 3,985,646 | 10/1976 | Oder | 209/223 R X |
| 4,261,815 | 4/1981 | Kelland | 209/223 R X |
| 4,322,257 | 3/1982 | Menth et al. | 148/101 |

FOREIGN PATENT DOCUMENTS

| | | | |
|---|---|---|---|
| 2645096 | 4/1977 | Fed. Rep. of Germany . | |
| 2929468 | 2/1981 | Fed. Rep. of Germany | 210/222 |
| 48172 | 4/1977 | Japan | 209/223 R |
| 191448 | 11/1982 | Japan | 210/222 |
| 816974 | 7/1959 | United Kingdom | 210/222 |
| 1594267 | 7/1981 | United Kingdom | 210/223 |

*Primary Examiner*—Kathleen J. Prunner
*Attorney, Agent, or Firm*—Stevens, Davis, Miller & Mosher

[57] ABSTRACT

A high-gradient magnetic separator is provided for filtrating weakly magnetic particles from a fluid in which they are suspended. The fluid is caused to flow through a separation chamber arranged in a gap formed between a pair of opposed pole surfaces of a pair of separate permanent magnetic devices connected with a closed magnetic circuit which includes yoke members. The permanent magnetic devices generate a strong magnetic field in the gap, the magnetic field having a field direction substantially transverse to at least a portion of the flow path of the fluid through the separation chamber. The permanent magnetic devices each include at least one permanent magnetic member having a substantially linear demagnetization curve. A matrix of soft magnetic material is located in the separation chamber to create local magnetic gradients in the magnetic field. The matrix includes strands extending in planes substantially transverse to the magnetic field direction. A major portion of the matrix strands have an orientation transverse to the magnetic field direction and to the main flow direction of the fluid.

17 Claims, 9 Drawing Sheets

HIGH-GRADIENT MAGNETIC SEPARATOR

This application is a continuation-in-part of applicants copending application Ser. No. 413,249, filed Aug. 30, 1982.

The invention relates to a magnelio separator for filtrating magnetizable particles from a fluid, in which they are suspended.

BACKGROUND OF THE INVENTION

Separators of this kind are used for the filtration of even weakly magnetic particles, i.e. particles of materials having a low magnetic susceptibility from a fluid, in which they are suspended, the fluid as such presenting a still lower magnetic background susceptibility. Even particles of a very small size down to colloidal or subcolloidal size may be separated in this way. A typical large-scale industrial application is the removal of contaminants from a slurry of kaolin or China clay, but also for water purification such as the removal of ochre or other impurities and the filtration of air suspended solid particles like fly ash magnetic separation may be used.

The selective removal of particles is due to the generation of a high intensity magnetic field in the separation chamber and the presence therein of a matrix of a soft magnetic material normally in the form of steel wool, a steel wire cloth or steel balls which are magnetized and create high local magnetic field gradients, whereby the particles to be extracted are trapped by the matrix material. After a certain time of operation, the matrix will become saturated and has to be cleaned, usually by water rinsing.

In known high-gradient magnetic separators, the high intensity field considered necessary for successful operation is generated by electromagnets either of the conventional resistive coil type, or by means of superconducting electromagnetic coils, the latter of which types seems to have gained particular interest due to the very high power consumption of ordinary electromagnetic coils.

However, even if superconducting electromagnetic coils cause a very substantial reduction of the demands on electrical power, they require a cooling system to bring them into the superconducting state, whereby the construction of such separators is made complicated and expensive and is less suitable for field operation.

In addition, the generation of high intensity magnetic fields by means of electromagnetic coils whether of the conventional resistive type or of the superconducting type will normally result in limitations with respect to separator design, which counteract optimization of the filtration process.

A typical known example of a high-gradient separator is the Kolm-Marston separator disclosed in U.S. Pat. No. 3,627,678, in which the electromagnetic coil, which may be of the cryogenic or superconducting type, is arranged in a recess in a heavy iron frame providing the magnetic return path. The slurry or fluid, from which magnetizable particles are to be extracted, is made to flow through the separation chamber parallel or antiparallel to the direction of the axial magnetic field from the coil. Even if the canister containing the matrix of soft magnetic material extends substantially throughout the magnetic air gap volume limited by the coil and the adjoining yoke parts of the return frame, it has appeared that particle capture is essentially limited to the upstream side of the individual matrix members. As a result, matrix saturation will occur after a limited period of operation and frequent cleaning of the matrix will be necessary. Since cleaning requires shutdown of the magnetic field, a complex flow control system is used in the Kolm-Marston separator to allow the flow of feed slurry to by-pass the separation chamber into a fluid return circuit in the cleaning periods, so that cleaning can be performed without removing the canister from the separation chamber. Since the shutdown periods necessary for demagnetizing the matrix are relatively long the duty cycle of this prior art separator is rather low.

Some of these operational diadvantages have been remedied in a separator disclosed in U.S. Pat. No. 4,124,503 by such a design of the separation chamber that a portion of the flow path for the feed slurry extends transversely to the direction of the magnetic field. The separation chamber has the form of a cylinder surrounded by an electromagnetic coil and comprising concentrical inner and outer tubular walls. The slurry enters the chamber in the central part limited by the inner tubular wall and leaves the chamber in the peripheral part outside the outer tubular walls, whereas the matrix material is confined to the space between the inner and the outer walls in which the slurry flows radially outwards. Thus, in this design the more effective utilization of the total volume of matrix material has been achieved at the expense of a decrease in efficiency caused by the fact that a substantial part of the magnetized gap volume is not occupied by matrix material and makes, therefore, no contribution to the separation.

Another example of a separator design involving a flow path for the feed slurry directed transversely to the magnetic field direction is the separator disclosed in U.S. Pat. No. 3,819,515, in which two electomagnetic coils are arranged at each side of the separation chamber, so that the axial field produced by each coil passes through the chamber transversely to the flow direction. Thereby, the separation chamber may be completely occupied by matrix material and contrary to the separator disclosed in U.S. Pat. No. 4,124,503, the flow path may be linear throughout the chamber. A heavy iron frame providing the magnetic return path is formed with bores for slurry inlet and outlet pipes, as well as a pipe system for supplying cleaning water to the separation chamber, which is not removed during matrix cleaning. Owing to the fact that the flowpath for the cleaning agent is shorter than the flowpath for the separation process, the duty cycle will be more favourable than that of the above-mentioned Kolm-Marston separator.

In French patent No. 2,475,935, which describes a method for cleaning the filter matrix of a magnetic separator without removing it from the magnetic field by raising the temperature of the matrix above the Curie point, it has been suggested to use a permanent magnet for the generation of the magnetic field for relatively low intensity applications whereas for high-gradient applications requiring a high intensity field like those mentioned in the foregoing then use of electro magnets is prescribed.

Also in Japanese patent No. 109265/78 it has been suggested to use permanent magnets in a low-intensity separator for the collection of easily magnetizable magnetite particles from a fluid.

For high gradient low intensity separation on a laboratory scale a small size magnetic separator has also been described in an article "A Bench Top Magnetic Separator for Malarial Parasite Concentration", by F. Paul et al in IEEE, Transactions on Magnetics, VOL MAG-17, No. 6, November 1981, pages 2822 to 2824 for the extraction of red blood cells infected with malarial parasites from whole blood and involving the generation of a magnetic field in a small size filtration chamber of a volume of 2–5 $cm^3$ by means of a conventional C-type Alnico magnet of the kind used in magnetrons.

The permanent magnet in this separator forms alone the entire magnetic circuit of the separator without such attention having been paid to the rather heavy magnetic losses in such a configuration.

SUMMARY OF THE INVENTION

According to the invention there is provided a new concept of a magnetic separator for filtrating magnetizable particles from a fluid, in which they are suspended, comprising a separation chamber having a pair of opposed chamber walls and a fluid inlet and a fluid outlet, means for causing said fluid to flow through said separation chamber along a predetermined flow path between the opposed chamber walls from said fluid inlet to said fluid outlet, a magnetic circuit comprising a pair of separate permanent magnetic devices connected with a closed magnetic circuit including yoke members and arranged with opposed mainly parallel pole surfaces on each side of an air gap adapted to receive said separation chamber, the pair of opposed chamber walls being in magnetic contact with a respective one of said pole surfaces for generating inside the separation chamber a magnetic field with a field direction substantially transverse to at least a portion of said flow path, and a matrix of a soft magnetic material arranged in said separation chamber to substantially fill up a part of the interior thereof extending between said pair of opposed chamber walls, said matrix thereby creating local magnetic gradients in said magnetic field, chamber inlet and outlet compartments being provided in the separation chamber at opposite ends of said matrix-filled part to be positioned outside said gap and communicating with said matrix as well as said fluid inlet and said fluid outlet, respectively, to define a main flow direction for said fluid through said matrix, each of said permanent magnetic devices comprising at least one member of a permanent magnetic material having a substantially linear demagnetization curve, said matrix comprising an arrangement of strands of said soft magnetic material extending mainly in planes substantially transverse to said field direction, and said closed magnetic circuit including said permanent magnetic devices and said air gap being proportioned as a whole to generate a substantially uniform magnetic field with an intensity, by which the individual strands throughout the matrix are substantially driven into a magnetic saturated state, when the separation chamber is positioned in said air gap.

By the combination of these measures, the present invention opens the possibility of designing a large scale high-intensity and high-gradient separator for industrial applications operating without external electrical power supply. As a result of the use of a member of a permanent magnetic material having a substantially linear demagnetization curve a high field intensity can be obtained with a pair of permanent magnetic devices having a relatively short flux path, so that the consumption of magnetic material will be restricted to a region on each side of the gap in the magnetic circuit. The magnetic circuit may be proportioned as a whole with a gap of relatively great cross-sectional dimensions transverse to the field direction to allow arrangement therein of a separation chamber of a great volume and filtration capacity. The magnetic circuit may be designed with due consideration to the magnetic losses along the flux path to obtain a desired strong magnetic background field throughout such a gap.

The arrangement of the matrix strands of soft magnetic material like steel wool to be disposed mainly in planes extending substantially transverse to the magnetic field direction contributes effectively to enhance the capture characteristics of the matrix and hence to improve the overall separation capability.

As further elaborated in the following the design and proportioning of the magnetic circuit as a whole to generate a magnetic field in the air gap of an intensity high enough to drive the individual matrix strands into a state of magnetic saturation may be accomplished in different ways.

On one hand, members of a powerful permanent magnetic material having a high BxH energy product may be incorporated in a relatively simple magnetic circuit configuration solely by interconnecting soft iron yoke members with the permanent magnetic members arranged directly adjacent the air gap.

On the other hand, optimization of the magnetic circuit configuration to provide a low-reluctance magnetic return path and a magnetically matched coupling to the air gap, possibly including a field concentration in the useful part thereof occupied by the matrix material in the separation chamber with a minimum of magnetic leakage, may allow the use of members of a less powerful magnetic material and/or relatively smaller dimensions of the permanent magnetic members to reduce the consumption of expensive magnetic material.

The design of a separator according to the invention opens the possibility of designing a large scale separator for industrial applications operating without external electrical power supply. As a result of the use of a member of a permanent magnetic material having a substantially linear demagnetization curve a great field strength can be obtained with a pair of permanent magnetic devices having a relatively short flux path, so that the consumption of expensive magnetic material will be restricted to the region close to the gap in the magnetic circuit. The magnetic circuit may be proportioned as a whole with a gap of relatively great cross-sectional dimensions transverse to the field direction to allow arrangement therein of a separation chamber of a great volume and filtration capacity. The magnetic circuit may be designed with due consideration to the magnetic losses along the flux path to obtain a desired strong magnetic background field throughout such a gap.

The design of a separator according to the invention may be relatively simple. In a typical embodiment, the gap between a pair of permanent magnetic devices arranged with opposed parallel pole surfaces will allow arrangement of a separation chamber of a mainly box-shaped configuration with a relatively small thickness corresponding to the width of the air gap.

Such a separation chamber may be formed as a canister arranged to be removable from the gap so as to allow cleaning of the matrix outside the magnetic field.

According to a particular aspect of the invention, a magnetic circuit having very small magnetic losses may be obtained in that each of said permanent magnetic devices comprises a pole shoe member of a magnetic soft material forming one of said pole surfaces, a first permanent magnetic member arranged in magnetic contact with a side of said pole shoe member opposite said air gap and parallel to said pole surface, said member having a direction of magnetization generally normal to said pole surface, and second magnetic members extending on each side of said pole member mainly transverse to said pole surface and having a direction of magnetization substantially perpendicular to that of said first member, the surfaces of said first and second magnets facing said pole shoe member having all the same magnetic polarity, said first magnetic member being in magnetic contact with said second magnetic members to provide a leakage-free enclosure for said pole shoe member.

In a preferred embodiment of such a separator the magnetic losses are minimized in that said pole shoe member has a uniform cross-sectional area transverse to the field direction therein, and that said second members are arranged in direct contact with the side faces of the pole shoe member.

BRIEF DESCRIPTION OF THE DRAWINGS

In the following, the invention will be explained in further detail with reference to the accompanying schematical drawings, in which.

DETAILED DESCRIPTION

Figure 1:
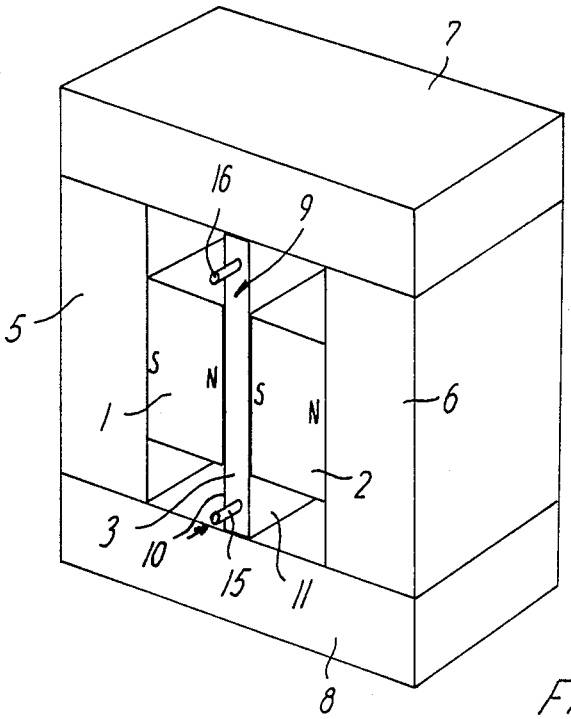
FIG. 1 is a perspective view of a basic embodiment of a high gradient magnetic separator according to the invention.
Figure 2:
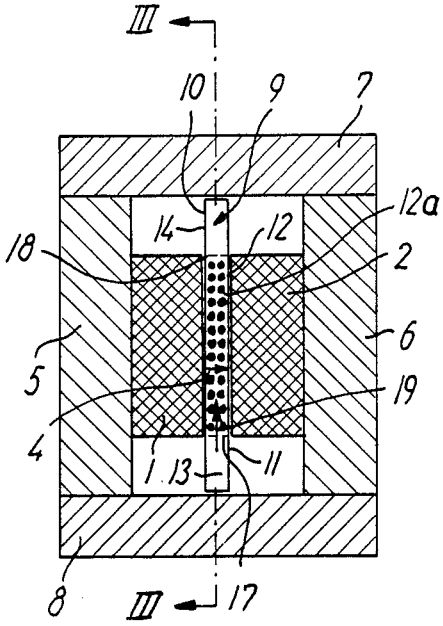
FIGS. 2 and 3 are sectional views of the embodiment of FIG. 1, with FIG. 3 being taken along line III—III of FIG. 2.
Figure 3:
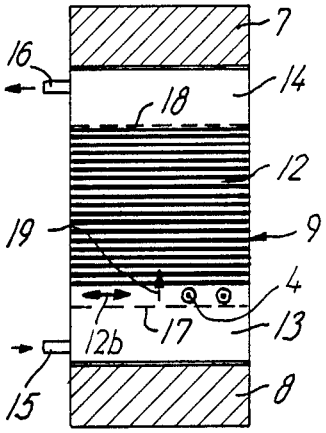

In the basic embodiment shown in FIGS. 1 to 3, two magnetic field generators in the form of permanent magnetic devices 1 and 2 are arranged with parallel opposed pole surfaces N and S, respectively, to generate a magnetic field in the gap 3 between the permanent magnets with a field direction as shown by the arrow 4 in FIG. 2.

A closed magnetic circuit is formed around the permanent magnets 1 and 2 by means of lateral yoke members 5 and 6 engaging the surfaces of the permanent magnets 1 and 2 opposite the gap 3, as well as transverse yoke members 7 and 8 engaging respective ends of each of the yoke members 5 and 6.

In the gap 3, a separation chamber 9 is arranged. In accordance with the shape of the air gap, the separation chamber 9 has a mainly box-shaped external form with opposite chamber walls 10 and 11 engaging the respective pole surface of each of the permanent magnets 1 and 2 on the entire surface area of the pole surfaces.

As best shown in FIGS. 2 and 3, the part of the interior volume of the separation chamber 9 located in the gap 3 is filled with a matrix 12 of a material creating high local gradients in the otherwise substantially uniform magnetic background field generated by the permanent magnets 1 and 2. The matrix 12 may consist, for example, of a corrosion resistant steel wool with a packing density of 5 to 40 percent of the part of the interior separation chamber volume occupied by the matrix 12 depending on the type and extent of contamination of the fluid to be processed by means of the separator. The part of the interior volume of the separation chamber 9 occupied by the matrix has an extension corresponding substantially to the surface area of the pole surfaces of the magnets 1 and 2.

The strands **12*a* of the matrix material are mainly disposed in planes extending substantially transverse to the magnetic field direction indicated by the arrow 4 and, as explained in the following, preferably so that a major portion of the strands have an orientation as shown by the arrow 12*b* transverse to the field direction as well as the flow direction of the fluid through the matrix 12**.

Figure 21:
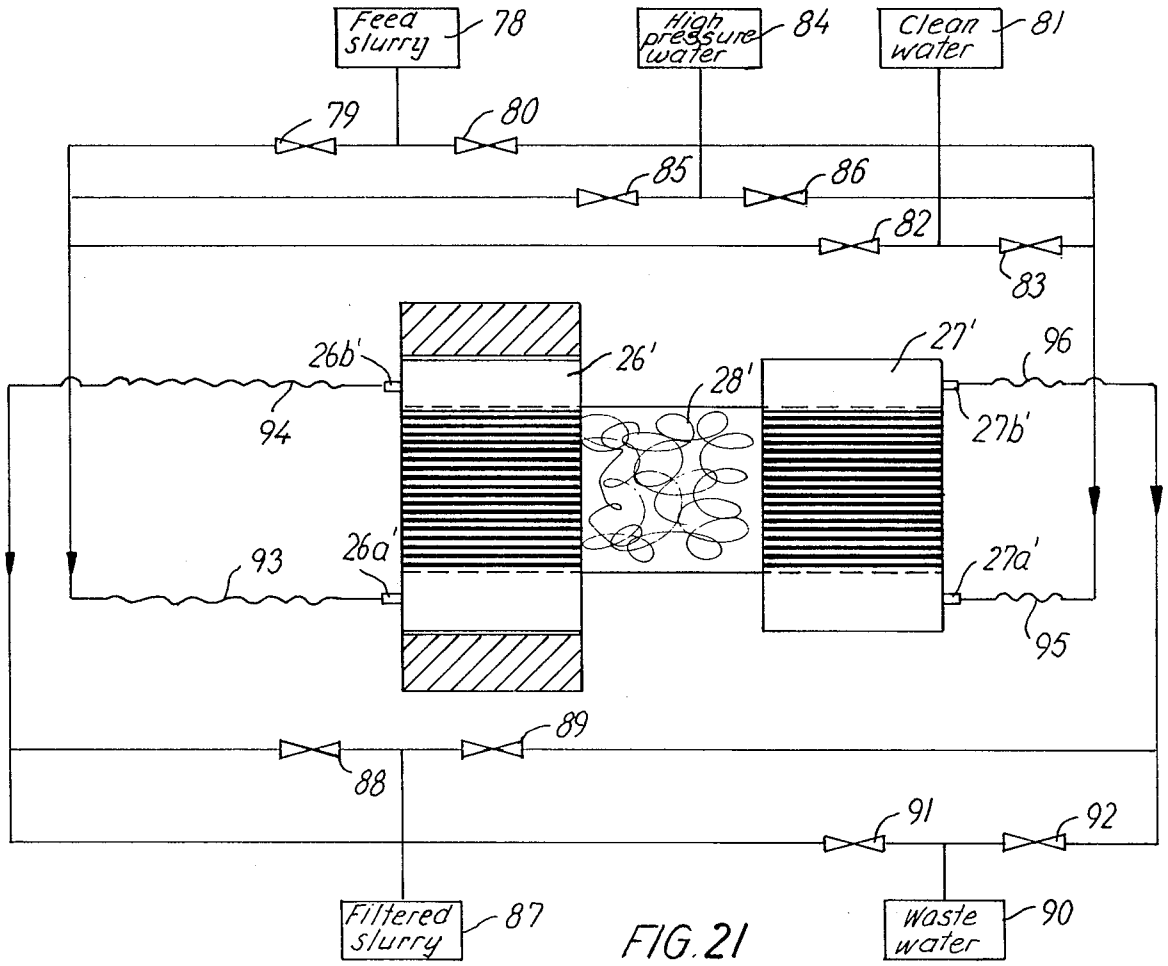
FIG. 21 is a schematic process diagram for a separator according to the invention.

Outside the volume part occupied by the matrix 12, the separation chamber 9 has inlet and outlet compartments 13 and 14 communicating with the matrix 12 as well as an inlet 15 and an outlet 16 for the fluid to be processed by the separator, said inlet 15 and outlet 16 being connected to a slurry feed and flow system of a configuration, e.g., as shown in FIG. 21. The compartments 13 and 14 of the separation chamber 9 are inwardly limited by partitions 17 and 18 engaging the matrix 12 and extending transverse to the opposite chamber walls 10 and 11 engaging the permanent magnets 1 and 2. As shown, the partitions 17 and 18 may be formed as grids to provide a distribution of the fluid over the matrix surface.

Thereby, a fluid supplied to the inlet 15 will be caused to flow through the matrix 12 with a main flow direction as shown by the arrow 19 in FIGS. 2 and 3, which is substantially normal to the magnetic field direction shown by the arrow 4.

The permanent magnetic devices 1 and 2 may each consist of a single magnetic member made from a magnetic material having a substantially linear demagnetization curve and preferably a high B×H energy product. Useful magnetic materials include hard ferrites and magnetic alloys comprising cobalt and at least one rare earth metal such as samarium. Magnetic materials of the latter kind have become known in recent years and have a maximum energy product up to 20 MGOe ($0.16 \cdot 10^6$ $J/m^3$). Mounted in a simple iron frame comprising yoke members 7 and 8 as shown in FIGS. 1 to 3 such magnets can economically generate a background field of the order of 5 to 7 kG (0.5–0.7 Tesla) without the use of field line concentrating pole pieces.

The separation in the chamber 9 is caused by the magnetic forces acting on particles suspended in the fluid flowing through the matrix in the direction shown by the arrow 19 as a result of the high local field gradients produced by the matrix material, whereby even relatively weak magnetic particles will be attracted to the matrix strands. The net result will depend on the interaction of these magnetic forces with fluid drag and gravity forces acting on the particles.

Figure 4:
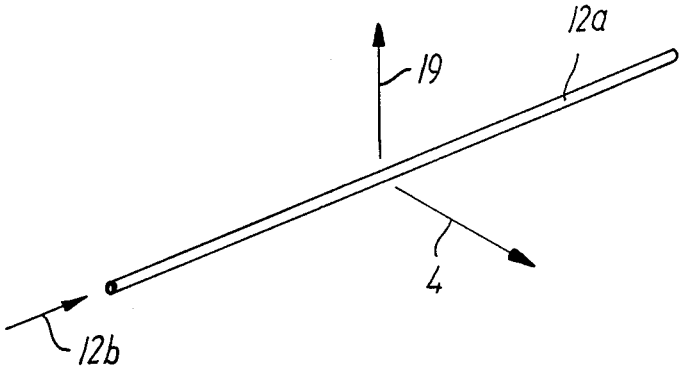
FIG. 4 is a schematical illustration of a single matrix strand with a preferred orientation with respect to the magnetic field and fluid flow directions.
Figure 5:
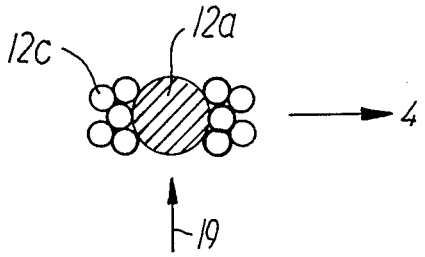
FIG. 5 is a schematic cross-sectional view illustrating particle capture by a matrix strand with the preferred orientation shown in FIG. 4.

As illustrated in the schematic diagram in FIG. 4 the optimum capture characteristics will be attained for matrix strands oriented in the direction shown by the arrow **12*b* transverse to the magnetic field direction 4 as well as the fluid flow direction 19 since with this orientation the strand 12*a* will collect more particles per unit of length and time, than a strand extending wholly or in part in the flow direction. For this reason a major portion of the matrix strands has this preferred orientation, by which particles in the fluid flowing through the matrix will typically be attached to diametrically opposite sides of the strand disposed in the magnetic field direction, such as shown in FIG. 5**.

As mentioned in the foregoing the matrix material should preferably be resistant to corrosional effects of the fluid processed by the separator. Various types of stainless steel and nickel have appeared to be useful matrix materials. Moreover, experiments have shown that optimum capture characteristics are obtained with matrix strands of a diameter in a range of 3 to 5 times the average size of the contaminant particles to be collected.

As a result of the use of the permanent magnetic devices 1 and 2, which will normally be of a regular brick-shaped form, a gap 3 of a similar regular form will be obtained between the parallel opposed pole surfaces N and S of thc magnetic devices allowing the use of a separation chamber 9 of a regular box-shaped form, the interior of which may be nearly completely occupied by the matrix material, since the compartments 13 and 14 communicating with the fluid inlet and outlet 15 and 16, respectively, must only have a size sufficient to secure even distribution of the fluid in the longitudinal direction of the chamber, i.e. transverse to the magnetic field direction as well as the fluid flow direction shown by the arrows 4 and 19 in FIG. 2.

Moreover, no special measures must be taken to obtain the field direction resulting in the most effective utilization of the trapping properties of the individual matrix strands, i.e. transverse to the main flow direction of the fluid, since this field direction will naturally present itself by a simple configuration of the magnet system as illustrated in FIGS. 1 to 3.

As a result of these advantages, the useful operation period of a separator according to the invention will be longer than for known high gradient separators of the electromagnetic type for the same matrix volume.

Figure 6:
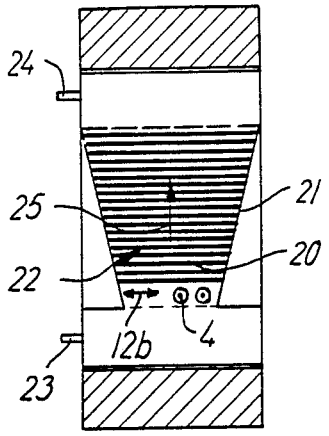
FIG. 6 is a sectional view corresponding to FIG. 3 and showing a modification of the separation chamber.

The ability to capture small-size particle fractions of contaminants as well as more weakly magnetic impurities may be enhanced by modifying the matrix volume in the separation chamber as shown in FIG. 6. In this modification, the matrix 20 is confined to a wedge-shaped space 21 in the separation chamber 22, so that the flow cross-sectional area for the fluid passing through the chamber from an inlet 23 to an outlet 24 will increase in the main flow direction shown by an arrow 25. By the resulting decrease of the fluid flow velocity in the flow direction 25, weak magnetic particles, which would otherwise show a tendency to pass through the separation chamber 22 without being captured by the matrix material, will get more easily captured at the downstream end of the matrix 20 presenting the greatest cross-sectional area for the flow.

During operation, the matrix in the separation chamber will become gradually saturated with particles from the fluid processed in the separator. In the same manner as in known high gradient magnetic separators, the separation chamber may then be regenerated by rinsing the matrix to remove the captured particles.

In the separator according to the invention, this regeneration will have to be performed outside the magnetic system in order to have the matrix material demagnetized. Therefore, the separation chamber is preferably formed as a canister which can be removed from the gap between the permanent magnets.

Figure 7:
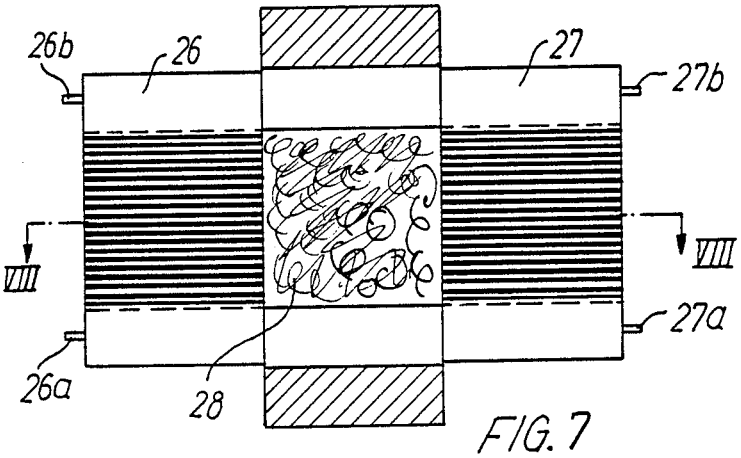
FIGS. 7 and 8 are sectional views of an embodiment comprising two interconnected separation chambers formed as displaceable canisters, with FIG. 8 being taken along line VIII—VIII of FIG. 7
Figure 8:
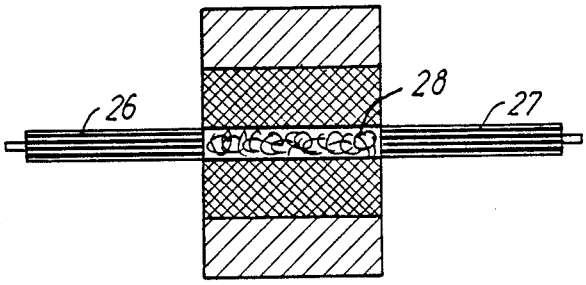

FIGS. 7 and 8 show an embodiment in which two active canisters 26 and 27 are connected with each other by means of an intermediate substantially corresponding canister 28 which is passive by having no fluid inlet or outlet. The interconnected canisters 26 and 27, each of which has a fluid inlet **26*a*, 27*a* and a fluid outlet 26*b*, 27*b*, are arranged for reciprocal displacement between two positions. In a first position canister 26 is disposed in the magnetic gap while canister 27 is disposed to a position sufficiently far outside the magnetic field to secure collapse of the magnetization of the matrix material whereby the matrix in this canister may be cleaned in accordance with the following description. In the other of the two positions the canister 27 is disposed in the magnetic gap, whereas the canister 26** is displaced outside the magnetic field to be cleaned.

By this arrangement a very favorable duty cycle can be obtained, since the only inoperative time intervals will be for the relatively short deviations of the displacement of the canister arrangement between the two positions. Outside these time intervals either one or the other of the canisters will be disposed in the magnetic gap for effective utilization of the magnetic field for filtration.

The intermediate canister 28 has a size corresponding to the magnetic gap between the pole surfaces and acts as a dummy load in the magnetic field so as to allow the magnetic field in the gap to remain substantially undisturbed during displacement of the canister arrangement i.e. with the field lines extending perpendicular to the pole surfaces whereby the displacement may be performed by the application of a moderate external force. The arrangement of canisters 26 and 27 interconnected by a dummy load canister to provide magnetic balance has been described in principle in an article "A Reciprocating Canister Superconducting Magnetic Separator" by P. W. Riley and D. Hocking in IEEE Transactions on Magnetics, Vol. MAG-17, No. 6 November 1981 pages 3299 to 3301.

Figure 9:
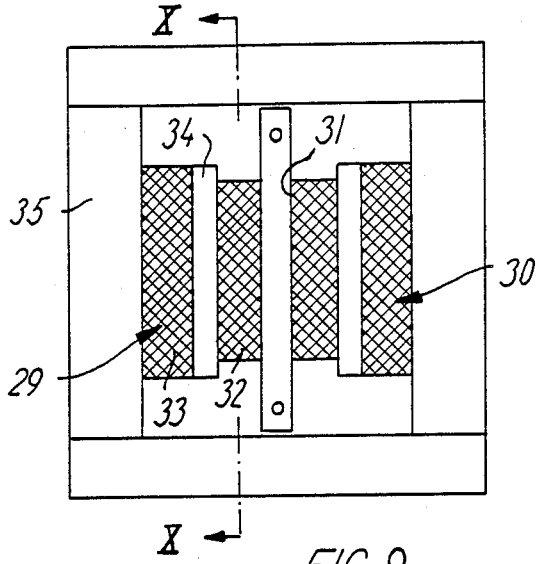
FIGS. 9 and 10 show a further embodiment of the separator with a modified magnet system.
Figure 10:
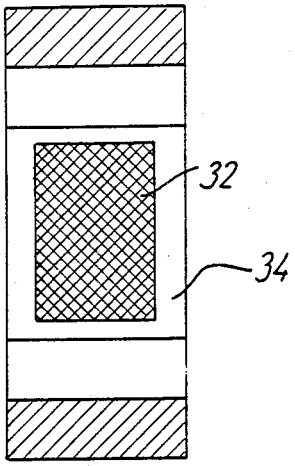

In FIGS. 9 and 10, a modification of the magnet system is shown in a lateral view and a sectional view along line X—X in FIG. 9, respectively, which is particularly advantageous from an economic point of view for generating a magnetic field of moderate to high strength. As already mentioned, the permanent magnetic devices in the separator according to the invention may comprise members consisting of a magnetic alloy comprising cobalt and a rare metal, such as samarium. These magnetic materials are relatively effective. Therefore, in the modified embodiment in FIGS. 9 and 10, the magnetic field is generated by a pair of opposed permanent magnetic devices 29 and 30, each of which comprises a stacked arrangement of a first magnetic member 32 facing the air gap 31 and being made of a material having a high energy product, such as the above mentioned magnetic alloy, and a second magnetic member 33 in contact with the yoke member 35 and being made of a cheaper magnetic material having a lower energy product, such as hard ferrites. The permanent magnetic members 32 and 33 are connected in the magnetic circuit through an intermediate soft iron coupling member 34, and preferably the magnetic members 32 and 33 should be proportioned in such a relationship to one another that their cross-sectional area normal to the interral field direction will yield substantially the same magnetic flux while their thicknesses in the field direction should yield substantially the same magnetomotive force.

By this modification, the amount of expensive magnetic material may be considerably reduced for the same magnetic field strengths in the gap 31. The stacked arrangement may comprise more than two permanent magnetic members with intermediate soft iron coupling members.

It will readily appear that one dominant factor in the design of a separator according to the invention will be the gap width in the magnet system, since a high magnetic field strength without too great magnetic losses can only be obtained with a reasonably small gap width. Therefore, an increased processing capacity of a separator according to the invention by increasing the matrix volume in the separation chamber should be obtained by increasing the length and height dimension of the separation chamber or canister while maintaining the width or thickness thereof at a relatively small value matching a relatively narrow gap. In a large scale separator according to the invention for industrial use, this may lead to great overall dimensions of the separator due to the demands on space for the separation chamber when using the basic embodiments shown in FIGS. 1 to 10.

Figure 11:
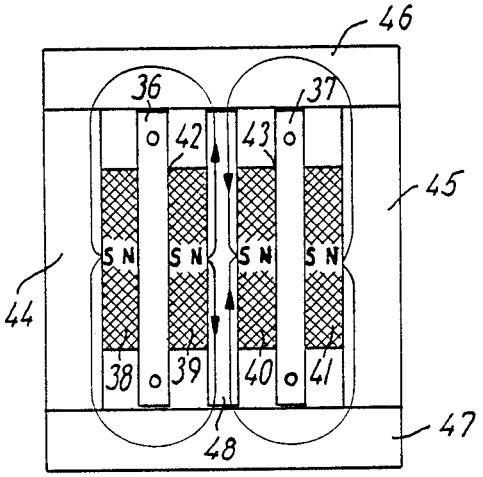
FIG. 11 shows an embodiment where two separation chambers arranged in parallel with respect to fluid flow are disposed in a separator embodiment having a magnet system with two sets of series-arranged pairs of magnet field generators.

A more economic solution with an increased processing capacity will be presented by modifying the separator as shown in FIG. 11. In this embodiment, two separation chambers 36 and 37, each of the same general design as shown in FIG. 1, are arranged in parallel with respect to fluid flow in a magnet system, in which two pairs of permanent magnetic devices 38, 39 and 40, 41, respectively, are arranged in series to define two parallel gaps 42 and 43, respectively, receiving each of the separation chambers 36 and 37. The permanent magnetic devices 38 to 41 form part of a magnetic circuit comprising a common yoke with external lateral yoke members 44 and 45 engaging the extreme permanent magnetic devices 38 and 41, respectively, and transverse yoke memers 46 and 47 connecting the lateral members 44 and 45.

As shown in FIG. 11, the two pairs of permanent magnets 38, 39 and 40, 41 may be separated by a central yoke branch 48. However, since the two pairs of permanent magnets ae arranged in series with a direction of magnetization of the magnets and directions of the closed-loop magnetic flux paths, as shown in FIG. 11, it will appear that the central yoke branch 48 will carry no resulting magnetic flux, since the flux contributions from each of the two closed-loop circuits will cancel each other. Therefore, the central branch 48 may, in principle, be elmminated or at least reduced in dimenions so as to serve only as a support for the inner permanent magnets 39 and 40 in each of the two pairs. Thus, in total the embodiment of FIG. 11 offers a considerable saving of iron for the flux return frame which for each of the two separation systems in composed of lateral yoke member 44 or 45, central branch 48 and the portions of transverse yoke members 46 and 47 extending between central branch 48 and actual lateral member 44 or 45. The series arrangement may be extended to comprise more than two separation chambers.

In the embodiment shown in FIG. 11, each of the air gaps 42 and 43 may have the same dmensions as in the embodiment in FIG. 1 allowing the arrangement of a separation chamber of the same size as in the FIG. 1 embodiment, whereby the processing capacity will be doubled at the expense of a moderate increase only of the overall dimensions of the separator.

Figure 12:
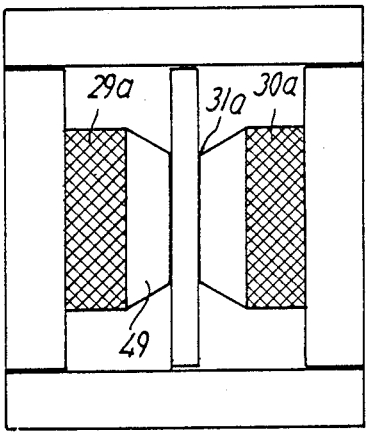
FIG. 12 shows a still further modification of the magnet system.

If a very high magnetic field strength in the air gap is to be obtained, a still further improvement of the magnet system may be obtained by a modiiication as shown in FIG. 12, in which parts of the separator corresponding to those shown in FIGS. 7 and 8 are designated by the same reference numerals. In this case, however, in each of the permanent magnetic devices **29*a* and 30*a*, which may have the same overall design of a stacked arrangement as shown in Figs. 9 and 10, the pole surface facing the gap 31*a* is constituted by a soft iron pole shoe meler 49 formed as a truncated pyramid with a cross-sectional area decreasing in the direction towards the gap 31*a*** to concentrate the magnetic field lines, whereby the field strengths in the air gap will increase.

FIGS. 13 to 18 show modifications of the magnet configuration in a separator according to the invention which are particularly interesting with respect to the losses in the magnetic circuit.

Figure 13:
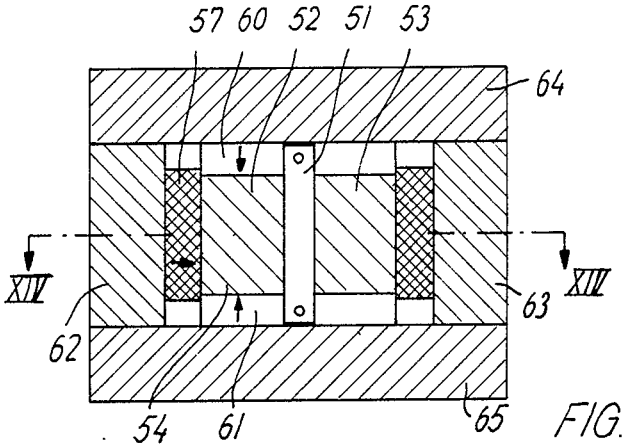
FIGS. 13 to 15 are cross-sectional views of a preferred embodiment of the magnet system, with FIG. 13 being taken along line XIII—XIII of FIG. 14 and FIG. 14 being taken along line XIV—XIV of FIG. 13.
Figure 14:
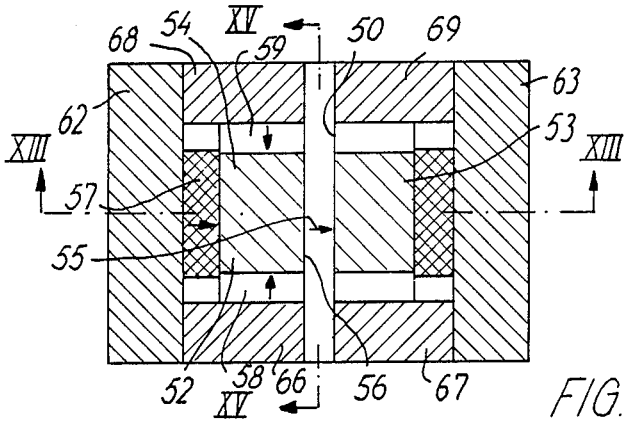
Figure 15:
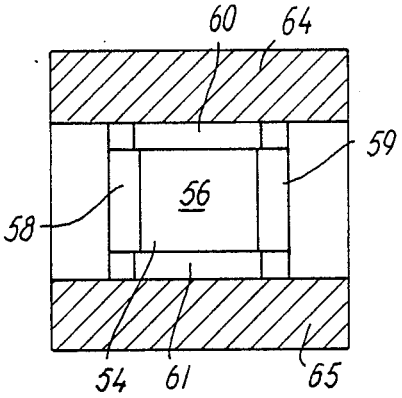
Figure 16:
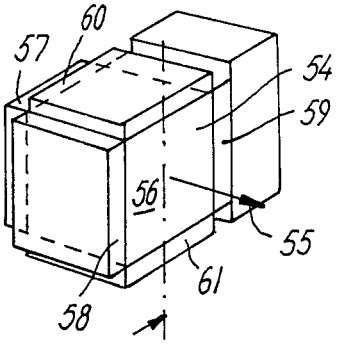
FIG. 16 is a perspective view of one of the permanent magnetic devices in the embodiment in FIGS. 13 to 15.

In the preferred embodiments in FIGS. 13 to 16, the magnetic circuit surrounding the gap 50, in which the separation chamber 51 is arranged as shown only in FIG. 13, is built up of two permanent magnetic devices 52 and 53, the construction of which is illustrated most clearly by the perspective view in FIG. 14.

Each of the permanent magnetic devices 52 and 53 incorporates a pole shoe member 54 of a magnetic soft material. In the embodiment shown, the pole shoe member 54 has a uniform cross-sectional area transverse to the field direction shown by an arrow 55. As shown, the pole shoe member 54 may have a generally box-shaped form with one surface 56 constituting the pole surface facing the gap 50.

A first permanent magnetic member 57 is arranged in contact with the side of the pole shoe member 54 opposite the pole surface 56 facing the gap 50 and, as best seen in FIGS. 13 and 14, the permanent magnetic member 57 is magnetized in the direction normal to the pole surface 56

On each of the sides of the pole shoe member 54 which extend transverse to the pole surface 56, a second magnetic member 58, 59, 60 and 61, respectively, is arranged in magnetic contact with the first magnetic member 57 so as to provide a leakage-free magnetic enclosure for the pole shoe member 54 on all sides thereof except the pole surface 56. As best seen in FIG. 14, the second magnetic members 58 to 61 are magnetized in directions perpendicular to the direction of magnetization of the first magnetic member 57, so that the surfaces of all the magnetic members 57 to 61 facing the pole shoe member 54 have the same magnetic polarity.

All the magnetic members 57 to 61 may have the form of flat brick-shaped members of a magnetic material having a substantially linear demagnetization curve such as ferrite, which is a relatively cheap maghetic material. The members 57 to 61 may all have the same thickness, or the thickness of the member 57 which could be considered as the main magnet may exceed that of the members 58 to 61 which could be considered as auxiliary side magnets.

On the sides of the magnetic members 57 to 61 facing away from the pole shoe member 54, yoke members are arranged. Thus, in addition to lateral yoke members 62 and 63 and transverse yoke members 64 and 65 corresponding to yoke members in the embodiments described hereinbefore, yoke members 66 to 69 are arranged, as shown in FIG. 14, on opposite sides of the separator transverse to the lateral yoke members 62 and 63 as well as the transverse yoke members 64 and 65. Except for the fact that the yoke members 66, 67 and 68, 69 on the same side of the separator are arranged with a gap corresponding to the gap 50 between the pole surfaces, all yoke members are arranged in magnetic contact with one another and have flat surfaces engaging the magnetic members 57 to 61 leaving cavities between all side edges of adjoining magnetic members. These cavities may be filled with a non-magnetic material not shown in the drawing.

Contrary to the embodiments described in the foregoing, in which the yoke members must be arranged in some distance from the permanent magnet members in order to reduce the magnetic losses, the modification in FIGS. 13 to 16 opens the possibility of arranging all yoke members 62 to 69 in direct contact with the permanent magnets 57 to 61.

Thereby a considerable saving of space and iron for the yoke members is obtained which is of great constructional and economic advantage particularly for large scale industrial separators having a separation chamber with a volume of several hundred liters.

The surprising effect of the magnetic configuration shown in FIGS. 13 to 16 is that the magnetic losses are reduced substantially to zero due to the presence of the auxiliary side magnets 58 to 61, meaning that substantially all field lines in the magnet circuit will be concentrated in the gap 50.

As a result thereof, a high intensity magnetic field can be built up in the gap 50 by means of relatively cheap permanent magnets of ferrite. It is readily obtainable to produce a magnetic field strength of the same order of magnitude as with magnets made from the considerably more expensive permanent magnetic cobalt-rare earth metal alloys described above.

While in the preferred embodiment in FIGS. 13 to 16 the pole shoe member 54 has a uniform cross-sectional area, and the auxiliary side magnets 58 to 61 are arranged in direct contact with the pole shoe member, a magnetic configuration having very small losses could also be realized by using a field concentrating pole shoe member having a pole surface, the area of which is smaller than the area of the opposite surface against which the main magnet is arranged.

Figure 17:
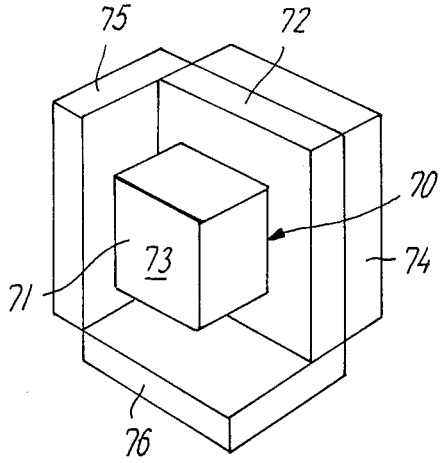
FIG. 17 is a perspective view of a modification of the permanent magnetic device in FIG. 14.
Figure 18:
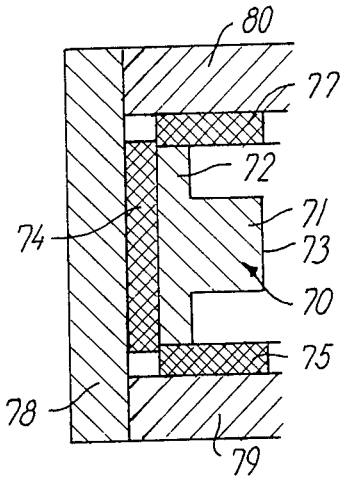
FIG. 18 is a cross-sectional view of a part of a separator comprising a permanent magnetic device as shown in FIG. 16.

As shown in FIGS. 17 and 18, such a pole shoe member 70 could have a substantially T-shaped cross-sectional profile with a leg 71 projecting from a base plate 72. The free end of the leg 71 forms the pole surface 73, and the main magnet 74 is arranged in contact with the base plate 72. In this case, the auxiliary side magnets are arranged on all side faces of the base plate 72, as shown at 75, 76 and 77, whereby they will be separated from the leg 71 forming the pole surface 73. Even if the losses are not reduced down to zero, since some field lines will extend outside the gap limited by the pole surface 73, the losses will be small and the degree of field line concentration high.

Also in the embodiments in FIGS. 17 and 18, yoke members which are only schematically shown at 78 to 80 should be arranged on all sides of the permanent magnets 74 to 77 facing away from the pole shoe member 70. The directions of magnetization of the permanent magnets 74 to 77 are the same as in FIGS. 11 to 14.

Even with a reduced size of the auxiliary side magnets and a somewhat increased open space between the side magnets on the two sides of the separation chamber, the losses will be small and the field line concentration high.

Figure 19:
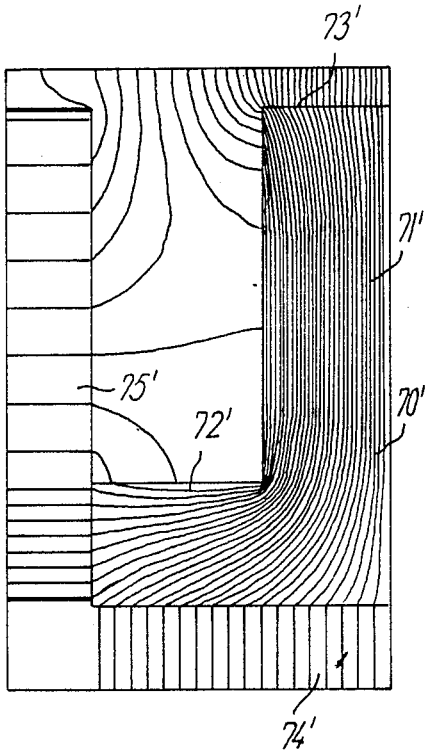
FIG. 19 illustrates the magnetic field line pattern in a magnetic circuit similar to the modification in FIGS. 17 and 18.

In FIG. 19, one quadrant of a two-dimensional magnetic circuit including a permanent magnetic device having a substantially T-shaped pole shoe member with a leg ing a substantially T-shaped pole shoe,, m;, 71' and a base plate 72', pole surfaces 73', as well as a main magnet 74' and an auxiliary side magnet 75' designed and arranged in the same manner as shown in FIGS. 17 and 18 is shown. The figure illustrates the magnetic field line pattern obtained by the Finite Element Method of solving Laplace's equation. It appears clearly from the higher field line density in the gap relative to the field line density of the permanent magnetic members that a considerable field line concentration in the gap is obtained. The portion of the field lines which does not reach the gap will represent the magnetic losses. The strength of the main magnet 74' as determined by the permanent magnetic material and the specific operating point in the BH diagram and expressed by the emitted field line density is higher than that of the side magnets.

Figure 20:
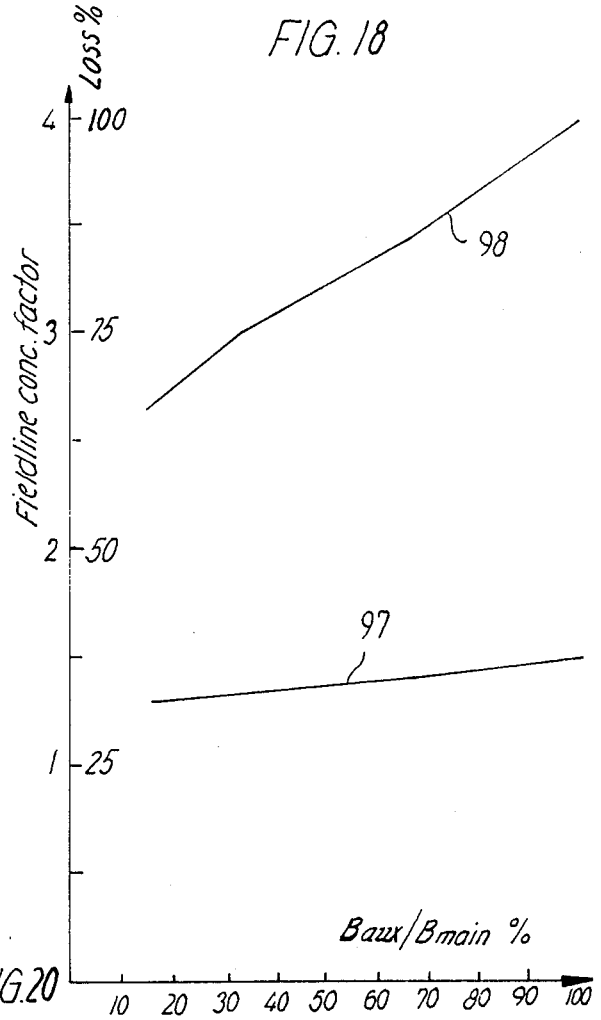
FIG. 20 is a graphic representation of field line concentration and magnetic losses in varying modifications of the magnetic circuits embodied in FIGS. 13 to 18.

FIG. 20 shows the effects on the field line concentration and the magnetic losses when varying the relative strength of the side magnets 75'. The curves 97 and 98 show the magnetic losses in percent and the degree of field line concentration, respectively, as a function of the side magnet strength $B_{AUX}$ relative to the main magnet net strength $B_{MAIN}$. The curve 97 shows that the side magnet as shown at 75' in FIG. 19 is not to be considered a "loss compensator", since an almost constant fraction of approximately 65% of the emitted field lines from the permanent magnets 74' and 75' reach the gap. On the other hand, the side magnets 75' strongly influence the field strengths in the gap.

This has been verified by experimentally designing a circuit of the type shown in FIG. 19 with a permanent magnet operated at 1.75 kG (0.175 Tesla). The design value of the gap field based on Finite Element Analysis would amount to 7 kG (0.7 Tesla), whereas a gap field of 7.2 kG was actually measured.

As permanent magnets, three pieces having dimensions of $70\times70\times10$ mm$^3$ made from polymer bonded samarium cobalt material were used in each half of the circuit, whereas the dimensions of the gap with respect to length, width and depth were 6 mms, 20 mms and 70 mms, respectively.

At first glance, it may seem surprising that the gap flux density, i.e. induction, obtained is significantly larger than the short-circuit induction, i.e. the remanence of the permanent magnetic material which as 5.5 kG (0.55 Tesla). This is due to the fact that induction is a density quantity. The total number of gap field lines, the gap flux, would, of course, not exceed the flux emitted by the permanent magnets.

It is observed from the above analysis that the magnetic losses are constituted by the flux being mainly parallel to the gap flux, but located in the space between the pole shoe member 70' and the side magnet 75'.

If the side branches of the base plate 72' of the pole shoe member 70' are reduced, then the magnetic losses will decrease. Thus, if the pole shoe member is modified from the general T-shaped cross-sectional form shown in FIGS. 17–19 to the more cubic shape, as shown in FIGS. 13 to 16, with side magnets mounted adjacent to the central leg 71' of the pole shoe member 70', then almost the entire resulting magnetic circuit will be lossless.

FIG. 21 shows a schematic process diagram illustrating the operation of a magnetic separator according to the invention provided with a series arrangement of three canisters 26', 27' and 28', the latter of which functions as a dummy load for the magnetic field during linear displacement of the canister arrangement.

A supply 78 of a fluid to be processed in the separator such as a slurry of kaolin or China clay from which contaminants should be removed is connected through valves 79 and 80, the fluid inlets **26*a'* and 27*a'* of the active canisters 26' and 27' respectively. A supply 81 of clean water at moderate or low pressure is connected to the fluid inlets 26*a'* and 27*a'* through valves 82 and 83 respectively. A supply 84 of water at high pressure is connected to the fluid inlets 26*a'* and 27*a'* through valves 85 and 86**, respectively.

A receiving vessel 87 for filtered slurry which has been processed in the separator is connected to the fluid outlets **26*b'* and 27*b'* of the active canisters 26' and 27' through valves 88 and 89, respectively, and finally a water waste recipient 90 is connected to the fluid outlets 26*b'* and 27*b'* through valves 91 and 92**, respectively.

In order to allow linear reciprocating displacement of the canister arrangement between the position shown in the figure and a position in which the canister 27' is disposed in the magnetic gap, whereas the canister 26' is displaced to a cleaning position outside the influence of the magnetic field flexible hoses 93 to 96 are incorporated in the supply and discharge lines leading tc and from the canister inlets **26*a'* and 27*a'* and the canister outlets 26*b'* and 27*b***, respectively.

The operation may comprise the following stages for each of the active canisters 26' and 27'.

1. With the canister 26' disposed in the magnetic gap valves 79 and 88 are opened for the supply of feed slurry to the fluid inlet **26*a'* and the discharge of filtered slurry to the vessel 87**, respectively.

2. After saturation of the soft magnetic matrix in the canister 26' as a result of the capture of magnetizable particles from the slurry passing through the matrix the valve 79 is closed.

3. While retaining the canister 26' in the magnetic gap the valve 82 is opened to allow flow of water through the matrix, whereby useful particles which have been trapped mechanically by the matrix material can be regained while the matrix is still in a magnetized state, and can be discharged to the vessel 87.

4. After closure of the valves 82 and 88 the canister arrangement is displaced linearly to the left in the figure to a position in which the canister 27' which during the filtration process in the canister 26' has been cleaned for magnetizable particles collected by the matrix material during a preceding operational cycle, is disposed in the magnetic gap, whereas the canister 26' assumes a position sufficiently for outside the magnetic field to secure effective collapse of the magnetization of the matrix.

Figure 22:
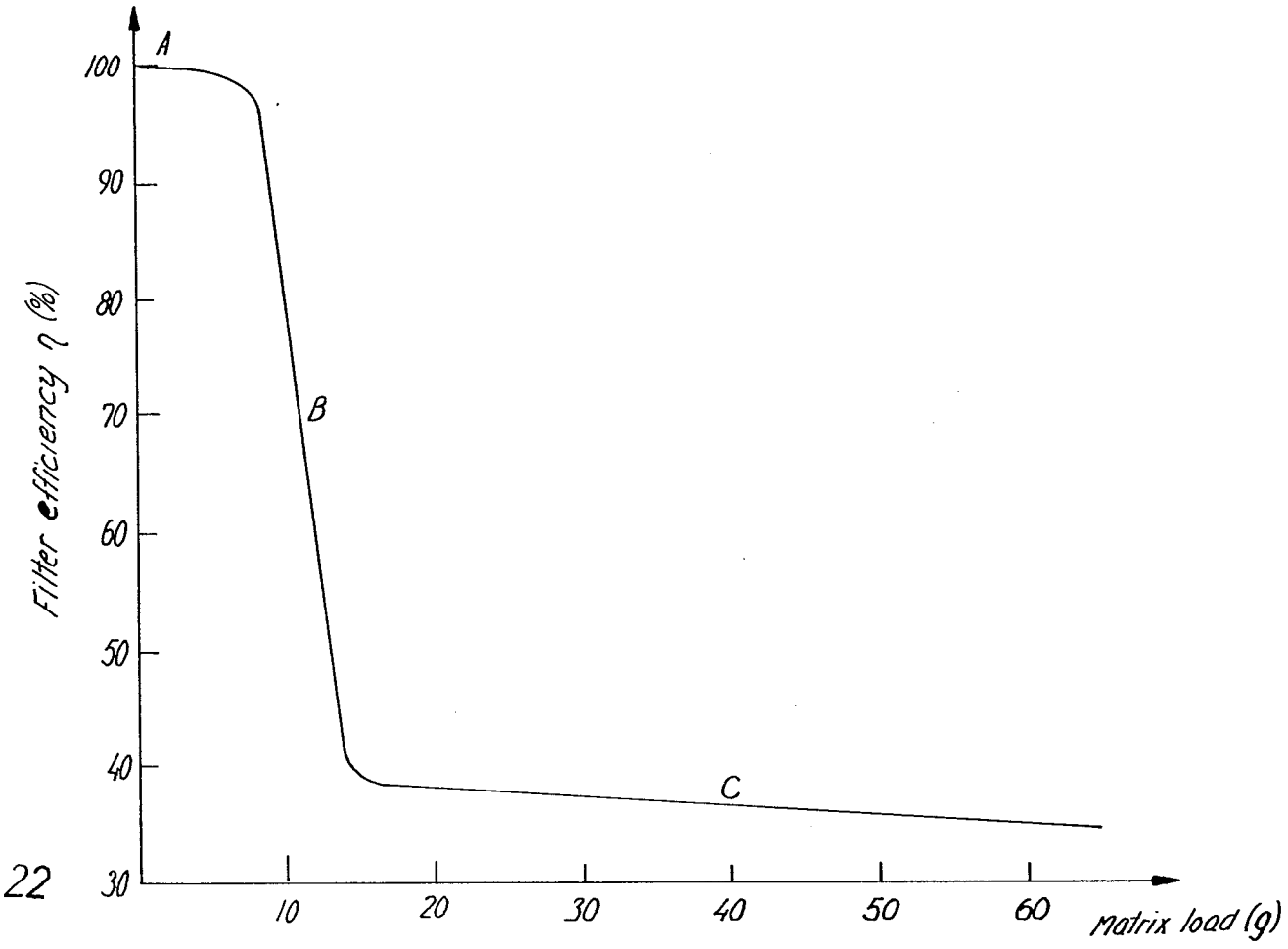
FIGS. 22 and 23 are graphic representations of experimental results obtained with a test separator according to the invention.
Figure 23:
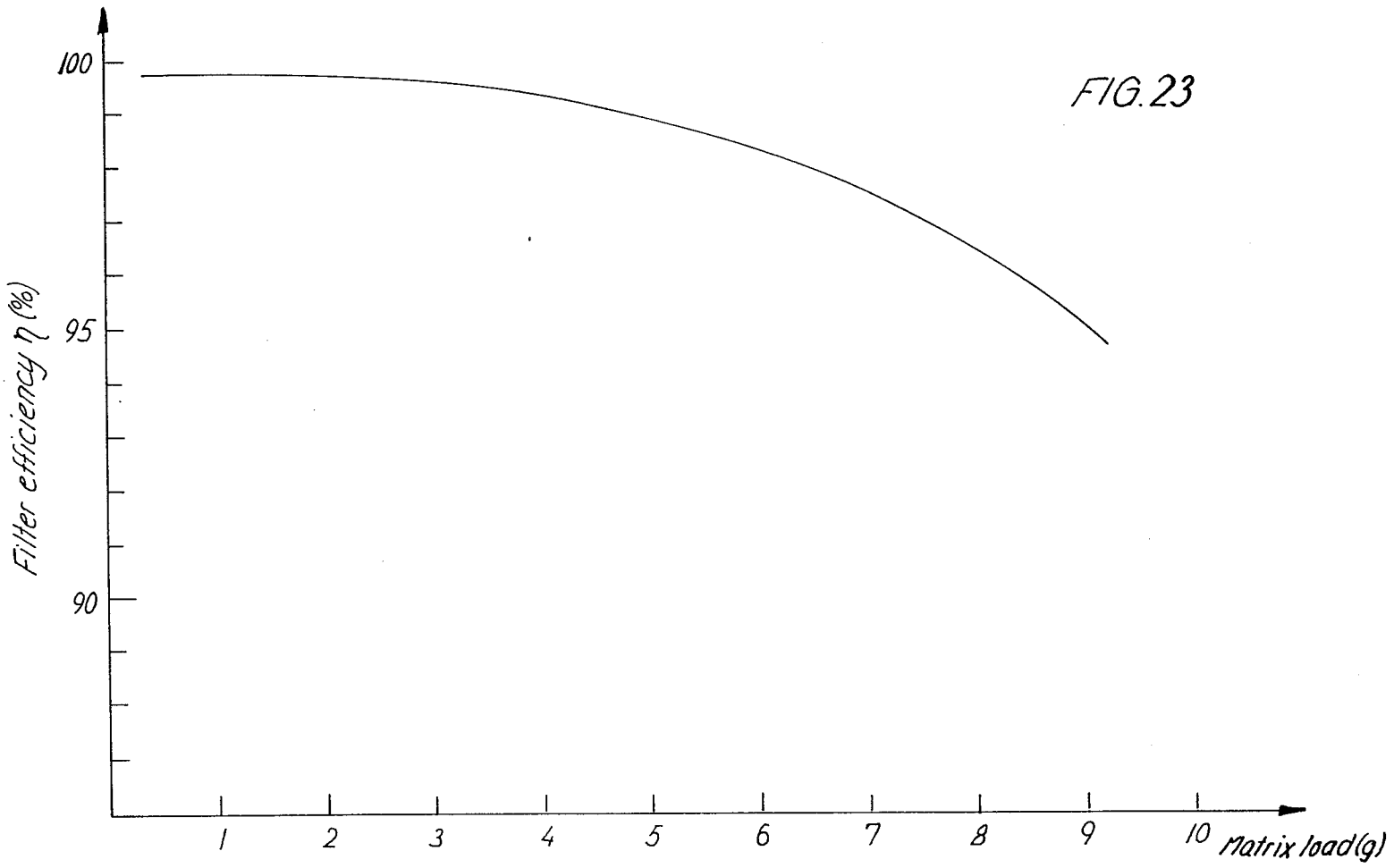

5. Valves 85 and 91 are now opened to supply water at high pressure to the canister **26*a'* to clean the matrix therein and discharge the waste water to the recipient 90. Simultaneously valves 80 and 89 are opened to supply feed slurry to the canister 27' and discharge filtered slurry to the vessel 87 whereby a new cycle of operation is initiated involving filtration in the canister 27' and cleaning of the matrix in the canister 26'. FIGS. 22 and 23** show a graphic representation of experimental filtration results obtained with a preliminary test embodiment of the separator according to the invention.

An experimental equipment was used corresponding in principle to the embodiment shown in FIGS. 1 to 3.

In the experimental equipment the separation chamber or canister consisted of a nylon block having width and height dimensions of 80 and 120 mms and a thickness of 10 mms. In this block the filtration volume was formed by a vertical centrally located cylindrical bore with a diameter of 50 mms closed by upper and lower cover plates of non-magnetic stainless steel mounted with O-rings to seal the canister, said bore being connected with inlet and outlet tubes for a test fluid.

In this bore a filtering matrix was arranged consisting of magnetic stainless steel wire-cloth, mesh 25 with a wire diameter of 0.4 mm formed into matrix elements shaped as circular discs having a diameter of 4.8 mms which were stacked inside the canister bore. The matrix contained 15 such discs representing a maximum matrix packing density of approximately 40% by volume. In operation, the canister was positioned vertically between the pole surfaces of a permanent magnet circuit having a gap of 15 mms. The permanent magnets on each side of this gap comprised two series arranged elements consisting of polymer-bonded SmCo supplied by magnetic Polymers, Ltd., England, and having an energy product of 7.5 kGOe (60 J/m$^3$), a remanence of 5.5 kG (0.55 Tesla) and a coercivity of 5 kOe ($4\cdot10^3$ Av/cm). The magnetic circuits operated at a B/H ratio of 3.0 resulting in a gap induction of 3.5 kG (0.35 Tesla).

As a test fluid, a slurry of 1 g of solid $MnO_2$ in 1 liter of tap water was supplied to the separator. This oxide is paramagnetic with a susceptibility of 2280 $10^{-6}$ cgs units and is commonly used as a test fluid in fundamental studies of high gradient magnetic separation. The particle size distribution was centered around 31 microns with 95% by weight smaller than 53 microns and 5% by weight smaller than 9.4 microns.

The filtering rate was 66.7 ml per min. corresponding to a retention time in the matrix of 17 sec.

Samples of the filtered slurry discharged from the canister outlet were collected on high-density membrane filters. The filtration efficiency $\eta$ of the magnetic filter was determined by the input and output concentrations $C_I$ and $C_O$, respectively, according to the equation:

$$\eta=(C_I-C_O)/C_I$$

wherein the output quantity $C_O$ was found from the weight gain of the dried collecting filters.

FIG. 22 shows the efficiency $\eta$ as a function of the total amount of solid $MnO_2$ fed to the separator.

If a slurry with constant concentration is fed to the separator, the figure would indicate the efficiency as a function of time, thus representing a "load line" for the equipment. The curve shown in FIG. 22 can be divided into three regions, viz.

a first high-efficiency region A showing a high degree of trapping of particles by in essence uncovered matrix strands, a second transition region B showing an exponentially decreasing efficiency due to reduced availability of trapping sites on the matrix strands, and a third saturation region C characterized by mechanical retention of particles on matrix strands already covered by paramagnetic particles.

High gradient magnetic separators are normally operated in the high-efficiency mode and commencing saturation, i.e. the start of the transition region of the curve in FIG. 22 is taken as the point, at which the matrix should be removed or replaced and cleaned.

The results obtained in the high-efficiency region A is illustrated in further detail in FIG. 23 and match fully with corresponding results obtained with electromagnetic devices.

However, the start of the transition region B seems to occur at a loading higher than expected. According to an established rule of thumb relating to separators of the Kolm-Marston type with a flow of fluid parallel or anti-parallel to the magnetic field, commencing saturation should be assumed to start at a load of 5% of the matrix weight. In the present situation with a matrix weight of 44 g, that would correspond to 2.2 g of $MnO_2$ fed to the separator. However, as shown in FIG. 23, the exponentially decreasing transition region B does not start until 3 g of $MnO_2$ has been fed to the separator.

Thus, the experimental filtration explained above demonstrates clearly that useful magnetic filtration with results even better than obtainable with conventional prior art electromagnetic separators can be obtained with a magnetic separator according to the present invention.

Although reference has been made above only to the processing of slurries, such as the removal of contaminants from a slurry of kaolin or china clay, it should be emphazised that separators according to the invention would be useful for the filtration of magnetizable particles from other kinds of fluds including gaseous fluids.

Moreover, the embodiments described should not be considered limiting for the invention, since numerous modifications can be made without departing from the scope of the claims.

I claim:

1. A magnetic separator for filtrating magnetizable particles from a fluid, in which they are suspended, comprising a separation chamber having a pair of opposed chamber walls and a fluid inlet and a fluid outlet, means for causing said fluid to flow through said separation chamber along a predetermined flow path between said opposed chamber walls from said fluid inlet to said fluid outlet, a magnetic circuit comprising a pair of separate permanent magnetic devices connected with a closed magnetic circuit including yoke members and arranged with opposed mainly parallel pole surfaces on each side of an air gap, said opposed chamber walls of said separation chamber being disposed in said air gap adjacent to said opposed pole surfaces, respectively, said pair of opposed chamber walls being in magnetic contact with a respective one of said pole surfaces, said magnetic circuit for generating inside the separation chamber a magnetic field with a field direction substantially transverse to at least a portion of said flow path, and a matrix of a soft magnetic material arranged in said separation chamber to substantially fill up a part of the interior thereof extending between said pair of opposed chamber walls, said matrix thereby creating local magnetic gradients in said magnetic field, chamber inlet and outlet compartments being provided in said separation chamber at opposite ends of said matrix-filled part with respect to said flow path to be positioned outside said gap and communicating with said matrix as well as said fluid inlet and said fluid outlet, respectively, to define a main flow direction for said fluid through said matrix, each of said permanent magnetic devices comprising at least one member of a permanent magnetic material having a substantially linear demagnetization curve, said matrix comprising an arrangement of strands of said soft magnetic material extending mainly in planes substantially transverse to said field direction, a major portion of said matrix strands having an orientation transverse to said magnetic field direction and said main flow direction for said fluid, said closed magnetic circuit including said permanent magnetic devices and said air gap being proportioned as a whole to generate a substantially uniform magnetic field with an intensity, by which the individual strands throughout the matrix are substantially driven into a magnetic saturated state, when the separation chamber is positioned in said air gap.

2. A magnetic separator as claimed in claim 1, wherein the cross-sectional area of the separation chamber transverse to said main flow direction increases in the main flow direction.

3. A magnetic separator as claimed in claim 1, wherein the separation chamber is formed as a generally box-shaped canister which is arranged to be removable from said gap in a direction perpendicular to the field direction by a linear displacement and is coupled at at least one of two opposite side faces normal to the direction of displacement to a further substantially corresponding canister containing a matrix of soft magnetic material acting as a dummy load for the magnetic gap during displacement.

4. A magnetic separator as claimed in claim 3, further comprising two additional generally box-shaped canisters and wherein said three canisters are arranged in series for linear displacement between first and second positions, in which either of the extreme canisters is disposed in said gap, whereas the other extreme canister is displaced to a position outside the gap for cleaning of said matrix.

5. A magnetic separator as claimed in claim 1, wherein each of said permanent magnetic devices comprises a stacked magnetic series arrangement of at least two members of permanent magnetic materials having different energy products with intermediate coupling members of a soft magnetic material, said members being stacked in an order of succession corresponding to increasing energy products in the direction towards said pole surfaces.

6. A magnetic separator as claimed in claim 5, wherein said permanent magnetic members are proportioned with cross-sectional areas normal to their internal field direction yielding substantially the same magnetic flux and with thicknesses yielding substantially the same magnetomotive forces.

7. A magnetic separator as claimed in claim 1, wherein the pole surface of each of said permarent magnetic devices is formed by a pole shoe of a magnetic soft material having a decreasing cross-sectional area in the direction towards the air gap.

8. A magnetic separator as claimed in claim 1, wherein each of said permanent magnetic devices comprises at least one member consisting of a permanent magnetic alloy comprising cobalt and at least one rare earth metal.

9. A magnetic separator as claimed in claim 8, wherein said rare earth metal is samarium.

10. A magnetic separator as claimed in claim 1, wherein at least two pairs of said permanent magnetic devices are arranged side-by-side to define at least two parallel air gaps to receive a respective one of a corresponding number of separation chambers with substantially parallel main flow directions for a slurry.

11. A magnetic separator as claimed in claim 10, wherein all permanent magnetic devices in said side-by-side arrangement are magnetically connected through a common yoke.

12. A magnetic separator as claimed in claim 1, wherein each of said permanent magnetic devices comprises a pole shoe member of a magnetic soft material forming one of said pole surfaces, a first permanent magnetic member arranged in magnetic contact with a side of said pole shoe member opposite said gap and parallel to said one of said pole surfaces, said member having a direction of magnetization generally normal to said one of said pole surfaces, and second magnetic members extending on each side of said pole shoe member mainly transverse to said one of said pole surfaces and having a direction of magnetization substantially perpendicular to that of said first member, the surfaces of said first and second members facing said pole shoe member all having the same magnetic polarity, said first magnetic member being in magnetic contact with said second magnetic members to provide a leakage-free enclosure for said pole shoe member.

13. A magnetic separator as claimed in claim 12, wherein said pole shoe member has a substantially T-shaped cross-sectional profile with a leg projecting from a base plate amd with the free end of said leg forming said one of said pole surfaces and said first magnetic ebr arranged in magnetic contact with the opposite end of said magnetic members being arranged parallel to said leg at either side of said base plate.

14. A magnetic separator as claimed in claim 13, wherein each of said second magnetic members extends beyond said base plate in the direction towards the gap.

15. A magnetic separator as claimed in claim 14, wherein each of said second members has a length corresponding to that of said leg.

16. A magnetic separator as claimed in claim 12, wherein said pole shoe member has a uniform cross-sectional area transverse to the field direction therein, and said second members are arranged in direct contact with side faces of the pole shoe member.

17. A magnetic separator as claimed in claim 12, wherein said first and second permanent magnetic members are made of ferrite.

* * * * *